US005165664A

United States Patent [19]

Cluff

[11] Patent Number: 5,165,664

[45] Date of Patent: Nov. 24, 1992

[54] CHAIN LINK FENCING WITH DECORATIVE SLATS

[76] Inventor: Robert G. Cluff, 4983 Cahoon Cir., Taylorsville, Utah 84118

[21] Appl. No.: 604,256

[22] Filed: Oct. 29, 1990

[51] Int. Cl.[5] ..... B21F 27/00

[52] U.S. Cl. ..... 256/34; 256/22; 256/50

[58] Field of Search ..... 256/34, 50, 66, 22

[56] References Cited

U.S. PATENT DOCUMENTS

| | | | |
|---|---|---|---|
| 2,954,964 | 10/1960 | O'Haffey | 256/34 |
| 3,712,590 | 1/1973 | Tochner et al. | 256/34 |
| 4,334,671 | 6/1982 | De Guise | 256/22 X |
| 4,553,741 | 11/1985 | Creasy et al. | 256/50 X |
| 4,723,761 | 2/1988 | Cluff | 256/34 |
| 4,725,044 | 2/1988 | Cluff | 256/34 |
| 4,995,591 | 2/1991 | Humphrey et al. | 256/34 |
| 5,007,619 | 4/1991 | Sibeni | 256/34 |

*Primary Examiner*—Andrew V. Kundrat
*Attorney, Agent, or Firm*—Terry M. Crellin

[57] ABSTRACT

In a chain link fence having a plurality of elongate slats woven through the links of the chain link fabric, an improved system for retaining and locking the slats in the chain link fabric comprises (1) an elongate rail woven between consecutive links of the chain link fence such that the rail lies adjacent to mutually respective, aligned, first ends of the elongate slats, and (2) engagement members formed integrally with the mutually respective first ends of the elongate slats, with the engagement members comprising a pair of separate, distinct, spaced apart barbs positioned adjacent to the respective side edges of the slat. The barbs make interlocking engagement with the elongate rail when the respective first end of the elongate slat is abutted against the elongate rail.

18 Claims, 3 Drawing Sheets

CHAIN LINK FENCING WITH DECORATIVE SLATS

BACKGROUND OF THE INVENTION

1. Field of the Invention

The present invention relates to chain link fences which have a plurality of decorative, elongate slats woven through the links of the chain link fabric of the fence. More particularly, the present invention relates to improved means for locking and retaining the slats in a uniform position along the fencing. Further, the present invention relates to an improved rail element and corresponding slats having engagement members formed integrally at the opposite side edges of mutually respective ends thereof, with the engagement members comprising means for interlocking engagement with the rail when the respective ends of the slats abut against the rail. The present invention further relates to a method of making the improved slats.

2. State of the Art

It is well known to insert slats in chain link fences to provide privacy and to improve the appearance of the fence. Unfortunately, there are two somewhat related, serious problems encountered in using slats in chain link fencing. First, the slats have a tendency to shift longitudinally after being inserted in the wire fabric of the chain link fence so as to become disarranged and uneven. Disarranged, uneven slats greatly impair the appearance of the fence. The second related problem is that the loosely positioned slats are easy prey for vandals. The slats are, unfortunately, easily removed from the fence by vandals.

Several methods have been proposed to alleviate these problems. The slats have been secured to the chain links in the fence by using staples, nails and other fasteners. In addition, systems have been proposed for interlocking the slats with channel members or elongate rigid connecting members which run along the length of the fence and which engage the slat members. The installation of such systems is a tedious, time consuming, costly operation. Prior to two U.S. patents which have been recently issued to me, no inexpensive, expedient means had been proposed to effectively cope with the vandalism problem. Some of the prior patent literature suggest complex systems which to some degree alleviates the vandalism problem, but as stated previously, these systems are unfortunately rather costly and require tedious, time consuming installation. Representative U.S. Patents which have been directed to retaining slats in position in chain link fences are:

| | | |
|---|---|---|
| 2,760,759 | 3,037,593 | 4,085,954 |
| 2,802,645 | 3,069,142 | 4,512,556 |

In two of my own previous patents, namely U.S. Pat. Nos. 4,723,761 and 4,725,044, I have disclosed novel means of retaining slats within the chain link fabric using clip members which engage the slats and prevent the slats from moving within the chain link fencing. In U.S. Pat. No. 4,725,044, a system is disclosed in which the clip members interconnect a respective end of a slat to a rail positioned adjacent to the end of the slat. Although the system using the clip to interconnect the slat to the rail has been commercially acceptable, it would be highly desirable to develop a system in which the ends of the slats interconnect directly with a rail positioned adjacent to the ends of the slat without requiring a separate clip member for interconnecting the slats with the rail.

In my copending application Ser. No. 07/364,825, filed Jun. 9, 1989, I disclose cutting a planar slit through one of the broad sides and extending into the lateral edges of the slat closely adjacent to an end of the slat. The slit in essence forms a broad, single tab extending the full width of the broad side of the slat. When the end of the slat is pushed into an elongate rail having two opposing sides that form an elongate opening therebetween, a lip on one of the sides of the rail pushes inwardly and engages the slit or tab. Engagement is made along the entire length of the slit across the entire width of the slat. This engagement has been found to be generally operable, but because the engagement centers on the central axis of the slat, the slat can be turned and disengaged from the slat. In addition, the broad slit across the entire broad side of the slat weakens the slat at the slit considerably. The weakening of the slat at the slit unfortunately allows the slat to disform at the slit and disengage from the rail.

OBJECTIVE

A principal objective of the present invention is to provide a new and improved rail and slat system in which engagement means are formed integrally on at least one of the opposite side edges of mutually respective ends of the slats to form a locking barb or element at the side edge of the stats. Preferably, engagement means are formed integrally at both of the opposite side edges of the slats to form two distinct, separate locking barbs or elements at the opposite edges of the slats. A locking rail is positioned along the mutually respective ends of the slats, wherein the two distinct, separate locking barbs of the slats make double, distinct, separate interlocking engagement with the rail so as to retain the slats at a uniform position along the fencing and locking the slats into the fence to thwart vandalism. The slat is much stronger than the slats of my previous application Ser. No. 07/364,825 and make much more stable engagement with the rail.

SUMMARY OF THE INVENTION

The above objective is achieved in accordance with the present invention by providing a chain link fence of the type including a plurality of elongate slats woven flatwise through the links of the chain link fabric of the fence in spaced, parallel arrangement. In one preferred embodiment, the slats have a hollow, flattened, tubular shape, and the slats comprise a pair of generally flat, spaced apart sides facing each other, with the two sides being joined along mutually respective lateral edges by curved edge walls which together with the sidewalls form a substantially enclosed, elongate space within the slat. The enclosed space defined by the walls of the slat is generally open only at the ends of the elongate slat. In a second preferred embodiment, the slats have an elongate, generally flat side, with the opposite elongate side edges thereof curved or bent away from the flat side to form opposite flanges extending in the same direction from the flat side. In this second embodiment, the slat is essentially an elongate, shallow trough, with the flat side forming the base of the trough and the curved side edges or flanges forming the sides of the trough. In a third embodiment that is similar to the first embodiment in that the slats have a pair of opposite sides, the sides are depressed toward each other along the longitudinal center lines thereof to form a transverse cross section through the slat having a generally FIG. 8 shape.

The present invention provides an improvement in means for retaining and locking the slats within the fencing by engaging the slats with a longitudinal rail that is woven between consecutive links of the chain link fence, wherein the rail lies adjacent to mutually respective, aligned ends of the elongate slats. At least one engagement member is formed integrally at one of the opposite side edges of the elongate slats. Preferably, a pair of distinct, separate, spaced apart engagement members are formed integrally at the opposite side edges of mutually respective ends of the elongate slats, with the engagement members comprising distinct separate barbs or catch elements at the opposite sides of the slats that make interlocking engagement with the elongate rail when the respective ends of the elongate slats are inserted between the sides of the rail.

Because the elongate rail is woven into the fencing substantially perpendicular to the elongate dimensions of the slats, the rail is bound by the links of the chain link fencing from movement in a direction along the elongate dimensions of the slats. When the slats make independent interlocks at the opposite sides of each slat with the rail, the slats are securely and independently held in the rail at both sides of the slats. The independent engagement at opposite side edges of the slats prevents the slats from movement along their longitudinal dimension. The distinct, spaced apart, two point engagement is made at the strongest portion of the slat, i.e., its curved side edges. It thus becomes very difficult for a vandal to dislodge the slat from the fence. In addition, the ends of the slats are uniformly positioned along the rail so as to improve the visual appearance of the fencing.

Additional objects and features of the present invention will become apparent from the following detailed description, taken together with the accompanying drawings.

THE DRAWINGS

Two preferred embodiments of the present invention representing the best modes presently contemplated of carrying out the invention are illustrated in the accompanying drawings, in which.

DETAILED DESCRIPTIONS OF THE PREFERRED EMBODIMENTS

The present invention involves an improvement in conventional chain link fencing in which elongate wires are bent in zig-zag manner and interlocked with one another to form a chain link fabric comprising a plurality of links 10. The bottom ends of adjacent wires of the chain link fabric may be interconnected by reversely bent end portions 12, and the upper ends of adjacent wires are interconnected by twisting the upper portions together. The twisted upper portions 14 present rather sharp barbs which discourage attempts to climb over the fence. It is the preference of some, however, to invert the chain link fabric so as to place the twisted end portions 14 at the bottom.

A plurality of elongate slats 16 are disposed in spaced, parallel relationship. In the illustrated embodiments, the slats 16 are woven through the chain links 10 so as to extend vertically relative to the fence. However, it should be recognized that the slats 16 could just as well be woven through the chain links 10 so as to extend horizontally relative to the fence. In accordance with the present invention, a combination of novel slats and cooperating rail are provided for retaining the slats in uniform positions along the fencing as well as physically locking the slats in the chain link fencing such that the slats cannot be readily removed or otherwise subject to vandalism.

Figure 3:
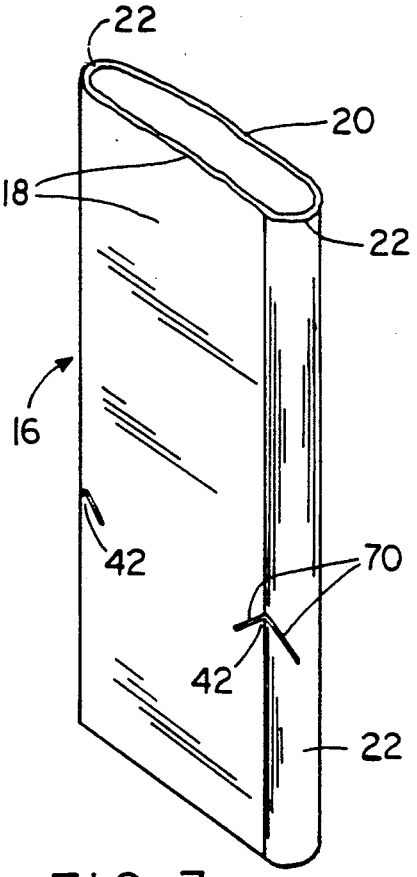
FIG. 3 is a fragmentary pictorial view of the end of a slat of FIG. 1 showing one preferred embodiment of engagement means for engaging the corresponding rail.

In one preferred embodiment, the slats 16 are made of a plastic material and are formed so as to have a flattened, tubular shape as best illustrated in FIG. 3. Such slats 16 have essentially flat front and back sides or faces 18 and 20, respectively, which are spaced apart, with the sides or faces 20 being substantially parallel to each other and in longitudinal alignment with each other. The sides 18 and 20 are joined along mutually respective lateral edges by curved end walls 22 to complete the elongate, tubular shape. An elongate space is enclosed within the tubular slats 16, with the space being generally open only at the ends of the slats 16.

Figure 4:
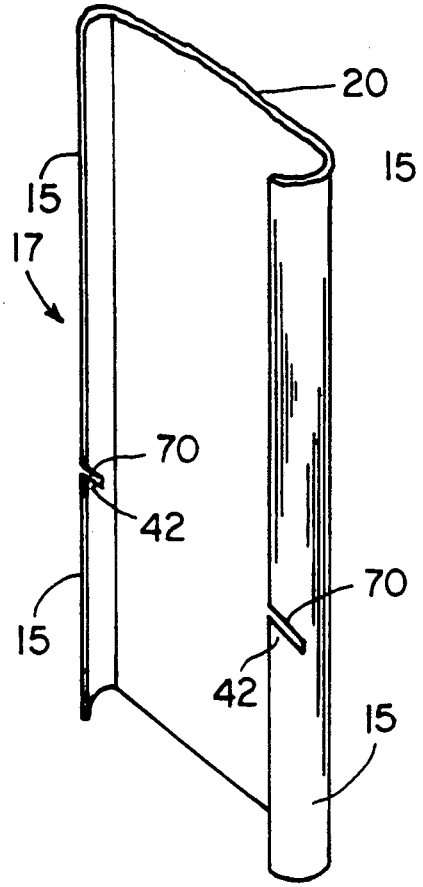
FIG. 4 is a fragmentary pictorial similar to that of FIG. 3 but showing an alternative embodiment of the slat and engagement means for engaging the corresponding rail.

A second preferred embodiment of slats is shown in FIG. 4. The slat 17 of FIG. 4 is preferably made of a plastic material, but the slat 17 is formed with only one flat face or side 20. Curved flange sections 15 extend from the opposite longitudinal sides of the single flat face 20 of the slat 17 in the same direction away from the slat 17. This forms an elongate, shallow, broad trough in which the single flat face or side 20 of the slat 17 forms the base of the trough, and the curved flanges 15 along the lateral side edges of the single flat face or side 20 form the opposite sides of the trough. The slat 17 of FIG. 4 is in essence the same as the slat 16 of FIG. 3 with the flat side 18 removed. The curved end walls 22 of the slat 16 of FIG. 3 would form the flanges 15 of slat 17 of FIG. 4 when the flat side 18 of the slat 16 of FIG. 3 is removed.

Figure 8:
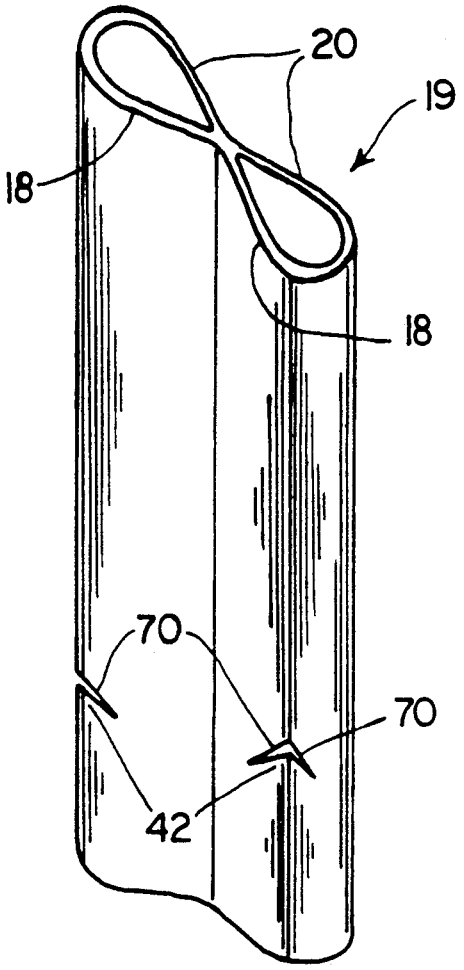
FIG. 8 is a fragmentary pictorial view of the end of a slat in accordance with the present invention wherein the slat has a cross sectional shape of a FIG. 8.

A third preferred embodiment of a slat in accordance with the present invention is shown in FIG. 8. The slat 19 is made of a plastic material and is formed so as to have a generally flattened, tubular shape similar to that of the slat 16 of FIG. 3. The front and back sides or faces 18 and 20 have however been depressed toward each other along the longitudinal center lines of the slat 19. The longitudinal center lines preferably are integrally joined. This can be done by shaping the slats 19 while the plastic material is still tacky, whereby the touching portions of the sides 18 and 20 fuse together along the longitudinal center lines of the sides 18 and 20. The slat 19 has a horizontal or transverse cross section having the general shape of a FIG. 8.

In accordance with the present invention, an improvement is provided in the means for retaining the slats, such as either slats 16, 17 or 19, at uniform positions and for securely locking the slats in the chain link fabric so as to prevent the slats from being removed from the fencing by vandals. As shown in the drawings, an elongate rail 28 is woven between consecutive links 10 of the chain link fence such that the rail 28 lies adjacent to mutually respective, aligned, first ends of the elongate slats 16 which are woven in the links 10 of the chain link fence substantially perpendicular to the rail 28.

Figure 7:
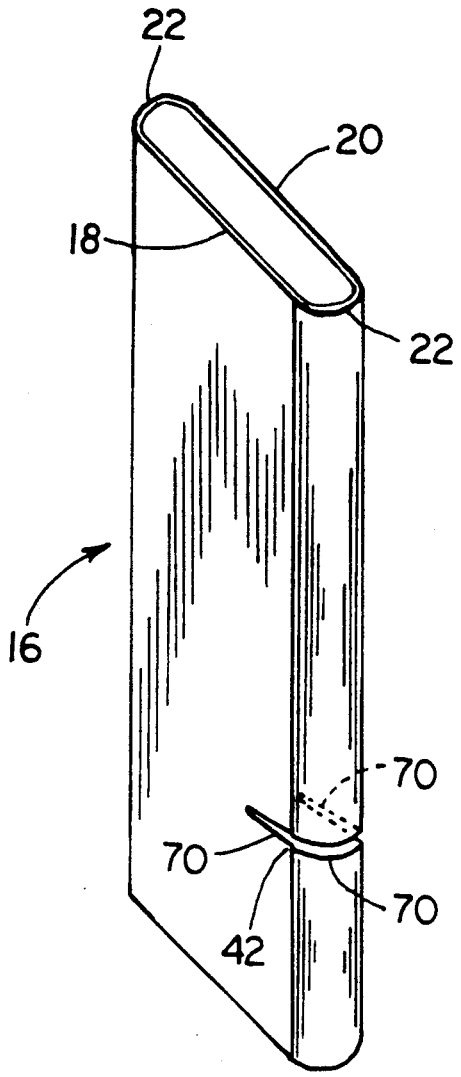
FIG. 7 is a fragmentary pictorial view of an end of a slat in accordance with the present invention wherein a single slit is cut completely through one of the side edges of the slat to form an engagement member at the side edge.

Engagement barbs or catch members 42 are preferably formed integrally at the opposite side edges of mutually respective first ends of the elongate slats 16, 17 or 19, with the separate, distinct barbs or engagement members 42 making double interlocking engagement with the elongate rail 28 when the respective first end of the elongate slat 16, 17 or 19 is inserted into the elongate rail 28. The rail 28 preferably has at least one elongate, engageable edge extending longitudinally therealong, and the interlocking barbs 42 on the slats 16, 17 and 19 make interlocking engagement with the engageable edge of the elongate rail 28. Instead of forming barbs or catch members 42 at opposite sides of the slats, a single barb or catch member 42 can be formed at one side of the slat as shown in FIG. 7.

Figure 1:
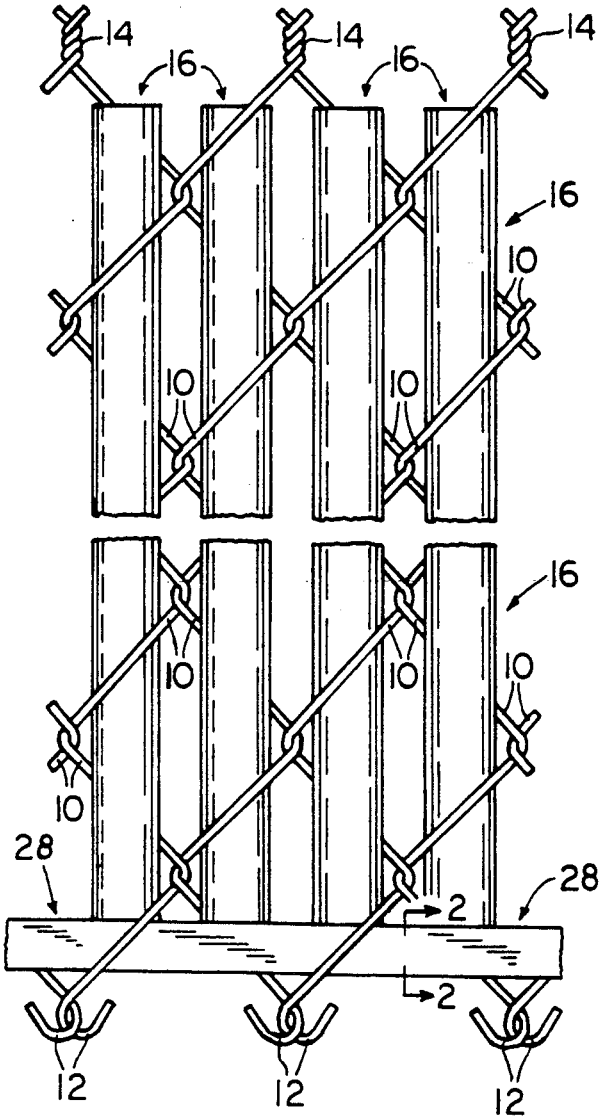
FIG. 1 is a fragmentary view in elevation of a portion of chain link fencing in accordance with the present invention.
Figure 2:
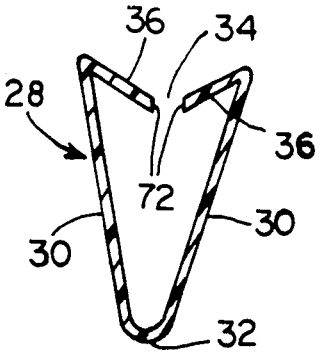
FIG. 2 is a cross section of a rail of the present invention as taken along line 2—2 of FIG. 1.

As illustrated in the drawings, the elongate rail 28 preferably has the shape of a trough in which two legs 30 extend from a base 32, with the free ends of the legs 30 lying adjacent each other in spaced position to form an elongate narrow opening 34 between the free ends of the legs 30. An elongate lip 36 extends inwardly from the free end of at least one of the legs 30 toward the central portion of the elongate rail 28, such that the lip 36 forms an elongate, engageable edge extending longitudinally along the rail 28. Preferably, a lip 36 extends from the free end of each of the legs 30 as illustrated in FIG. 2.

The rail 28 can have several advantageous cross-sectional shapes as shown in the drawings of my copending application Ser. No. 07/364,825, and these shapes are incorporated herein by reference. As shown in FIG. 2 of the present application, the base 32 is rather narrow, and the legs 30 slope outwardly away from each other.

Figure 5:
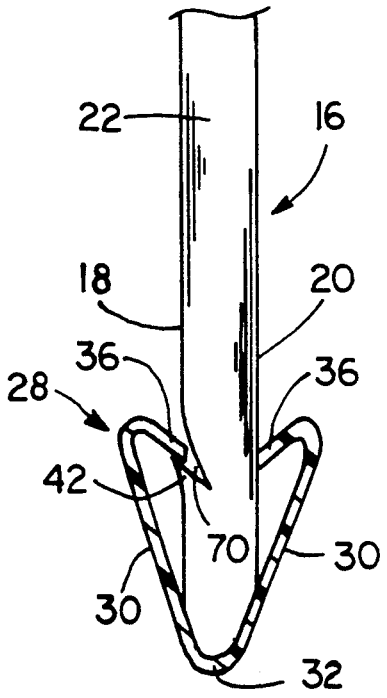
FIG. 5 is a side elevation of the slat of FIG. 3 making engagement at one of its side edges with the rail of FIG. 2.

The engagement members on the ends of the slats 16, 17 and 19 are preferably formed by integral barbs 42 formed at least one of the side edges and preferably at each of the mutually respective side edges of the elongate slats 16, 17 and 19 as shown in FIGS. 3, 4 and 8. The barbs 42 are preferably formed by separate, distinct planar slits 70 cut in the respective side edges of the slat 16, 17 and 19 as shown in FIGS. 3, 4 and 8. When a mutually respective end of a slat is inserted in the narrow opening between the free ends of the legs 30 of the corresponding elongate rail 28, the barbs 42 formed by the slits 70 interlocks and engages with the lip 36 at each of the opposite side edges of the slats 16, 17 and 19 to retain the end of the slats within the narrow opening in the elongate rail 28 as shown in FIG. 5.

Particularly preferred embodiments of inexpensive, easily manufactured slats 16, 17 and 19 and interlocking rail 28 are shown in the drawings. The rail 28 is basically as described hereinbefore, with two sides 30 which extend from an elongate base 32 to form the general shape of a trough in which the margins of the sides 30 lie adjacent to each other to form an elongate opening therebetween. Elongate, engageable lips 36 project inwardly from the margin of at least one of the sides 30 of the rail 28 toward the central portion of the rail 28. Preferably, the lip 36 slants so as to form an acute angle of between about 5 and 85 degrees, and preferably between about 25 and 70 degrees, with the respective side 30 of the rail 28. The free lateral edge 72 of the lip 36 can have a substantially sharp knife-edge pointing toward the base 32 of the rail 28, but it has been found that a conventional rounded or squared shape formed during extrusion is just as effective.

In the embodiment of the slat 16 or 19, as illustrated in FIGS. 3 and 8, a planar slit 70 is cut by a sharp edged instrument in each of the separate, distinct sides of the slats 16 and 19 closely adjacent to the end thereof. Each of the distinct, separate slits 70 is cut through a broad side 18 at opposite respective sides edges of the slat, and the slits 70 extend into the lateral side edges of the slat 16 and 19 by a distance of at least about the wall thickness of the lateral edges 22 of the slat 16 and 19 and no greater than all the way through the curved lateral edges 22. Each of the slits 70 can be cut essentially perpendicular to side 18 of the slat, but preferably, each of the slits 70 is inclined such that the plane of the slit slants inwardly from the one side 18 of the slat 16 or 19 toward the adjacent end of the slat 16 or 19. The plane of each slit 70 preferably slants so as to form an acute angle of between about 5 and 75 degrees with the respective side 18 of the slat 16 or 19. Preferably, each slit 70 extends about one tenth and no greater than about three fourths of the way through the curved lateral sides 22 of the slat 16 or 19, and in a most preferred embodiment, the slit 70 extends about one quarter to one half way through the curved lateral sides 22 of the slat 16 or 19.

As can be seen from FIGS. 3 and 8, the slits 70 do not extend entirely across the width of the broad side 18 of the slat 16 or 19. Each slit 70 extends no greater than about three eighths of the distance through the width of the broad side 18 of the slat 16 or 19. This leaves at least about one fourth of the width of the broad side 18 intact. Of course, the entire other broad side 20 of the slat 16 or 19 is not cut at all. The two intact sides 18 and 20 of the slat 16 or 19 results in retention of exceptional strength. The barbs 42 as formed by the slits 70 are formed at opposite side edges of the slat 16 or 19 and make rigid two point engagement with the rail 28 when the end of the slat 16 or 19 is pushed into the rail 28 as shown in FIG. 5. The strength of the barbs 42 are exceptionally superior to a tab formed by a slit extending entirely across the broad side 18 of the slat. And as mentioned previously, the two intact, broad sides 18 and 20 of the slat 16 retain exceptional strength in the slat 16 or 19.

In the embodiment of the slat 17, as illustrated in FIG. 4, the slits 70 are formed directly in the outer extending portion of the flanges 15 at the opposite lateral side edges of the broad side 20 of the slat 17. In this embodiment, the slits 70 may extend through the flanges 15 from the outer edge to the junction with the broad side of the slat 17. Preferably, however, each slit 70 extends between about one tenth and no greater than about three fourths of the way through the flanges 15. In a most preferred embodiment, the slits 70 extend about one quarter to one half way through the flanges 15.

As illustrated in FIG. 5, when the end of either of the slats 16, 17 or 19 (with slat 16 being shown in FIG. 5) is inserted in the opening 34 between the lips 36 and sides 30 of the rail 28, the lip 36 of the rail 28 interlocks and engages at two independent, distinct point of engagement. The two points of engagement are the barbs 42 at the opposite side edges of the slat. The engagement retains the end of the slat within the opening or trough of the rail 28. As can be seen from the drawings, the barb 42 is spaced from the end of the slat 16 such that the end of the slat tends to engage the sloped sides of the rail when the lips 36 engage the barb 42. Depending upon the size of the rail 28, the portion of the barb 42 will generally be spaced from the end of the slat by between about one fourth inch and one inch.

Either of the embodiments of the slats 16, 17 or 19 shown in FIGS. 3, 4 and 8 make exceptionally good two point engagement with the lip 36 of the rail 28. When the ends of the slats are inserted into the rail 28, the sides 30 and opposing lips 36 are forced apart, and the lips 36 apply pressure to the opposite, broad surfaces of the slats. The pressure of the lip 36 positioned immediately above the slits 70 forming the barbs 42 tends to compress the side 18 of the slat 16 inwardly so as to expose the edges of the barbs 42 formed by the slits 70. The edge 72 of the lip 36 then makes positive engagement with the barbs 42. Any force in the slats tending to withdraw them from the rail 28 acts to further embed the edge of the lip 36 into the slits 70 forming the barbs 42. Thus, the slats are effectively interlocked with the rail 28.

It should also be noted here that the links 10 of the fencing fabric engage the outer surfaces of the sides 30 of the rail 28 to add support to the sides 30 of the rail. This support augments the pressure applied by the lips 36 to the ends of the slats 16, 17 or 19 which are inserted between the lips 36 of the rail 28. Further, by spacing the slits 70 forming the barbs 42 at a proper distance from the ends of the slats, the ends of the slats will engage the converging inner surfaces of the sides 30 of the rails 28. The ends of the broad sides 18 of the slats will thus be compressed which tends to push the adjacent edge of the slits 70 outwardly to more readily engage the edges of the lips 36 of the rail 28.

Figure 6:
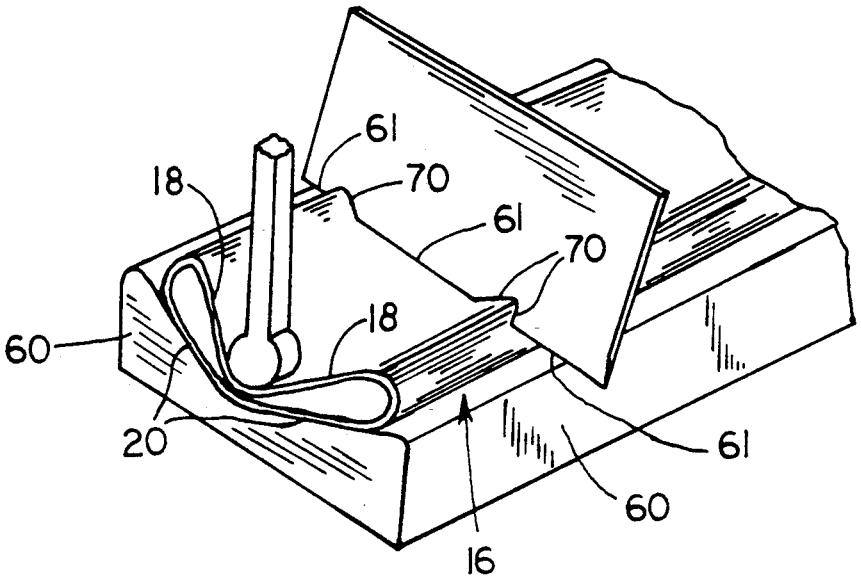
FIG. 6 is a fragmentary pictorial view of the end of the slat of FIG. 3 as it is held in a die and a cutting blade is employed to form the two separate, distinct barbs or catch elements on the opposite side edges of the slat.

The slits 70 in the embodiment of the slats 16 shown in FIG. 3 are formed by advantageously placing the end of the slats 16 over a flat die or a concave die as shown in FIG. 6. The end of the slat 16 is depressed along its longitudinal central axis to press the central portion of the upper broad side 18 toward the lower broad side 20 and to make the two broad sides take the concave shape of the die. This leaves the two side edges of the end of the slat projecting upwardly from the depressed central portions of the broad sides 18 and 20.

A sharp knife edge 61 is then used to cut the separate, independent slits into the upwardly projecting side edges of the slat 16 as shown in FIG. 5. This forms a particularly desirable angled or arcuate slit 70 at each side edge of the slat 16. The slit 70 can be formed to advantageously have an apex closely adjacent to the intersection of the broad side 18 and the curved lateral edges 22 of the slat 16 as shown in FIG. 3. Each slit 70 slants or curves downwardly, with one side of the slit 70 arcing or slanting downwardly into the broad side 18 of the slat 16 in a direction toward the near end of the slat. The other side of the slit 70 arcs or slants downwardly into the curved lateral edge 22 in a direction toward the near end of the slat 16. The apex of the arcuate slit 70 forms the engagement point of the barb 42 for engaging with the lip 36 of the rail 28.

One of the advantages of the FIG. 8 shaped slat 19 of FIG. 8 is that the central portion of the end of the slat need not be held down on a die as explained above. The depressed center line of the FIG. 8 shaped slat 19 allows a sharp knife edge to cut the separate independent slits 70 into the side edges of the slat 19 without any external means being used to depress the side 18 of the slat 19.

The slat 16 shown in FIG. 7 is very similar to the slat 16 shown in FIG. 3, with the only difference being that only one catch member or engagement barb 42 is formed in the slat 16 of FIG. 7, and the barb 42 is formed by a single slit 70 on the one side edge of the slat 16. The slit 70 of the slat 16 shown in FIG. 7 extends completely through the side edge 20 of the slat 16 and extends a short distance into both the front and back sides 18 and 20 of the slat 16.

It is to be understood that the present disclosure, including the detailed description of preferred embodiments, is made by way of example and that various other embodiments are possible without departing from the subject matter coming within the scope of the following claims, which subject matter is regarded as the invention.

I claim:

1. In chain link fencing of the type including a plurality of elongate slats which have first and second longitudinal ends, with each slat being characterized by a pair of broad, elongate sides which are spaced apart by a pair of lateral edges that join the opposite sides together to form a substantially hollow, flattened, tubular shape, wherein said slats are woven flatwise through the links of the chain link fabric of the fencing in spaced, parallel arrangement, an improvement in means for retaining and locking the slats within the fencing, and improvement comprising an elongate rail woven between consecutive links of the chain link fence such that the rail lies adjacent to mutually respective, aligned, first ends of said elongate slats, said rail having two sides which extend from an elongate base to form the general shape of a trough, with the extending margins of the sides of said rail lying adjacent to each other to form an elongate opening therebetween;

an elongate, engageable lip projecting inwardly from the margin of at least one of the side of said rail toward the central portion of said elongate rail; and at least one barb positioned adjacent to one of the respective lateral edges of each of said slats, whereby when a mutually respective first end of a slat is inserted in the opening between the sides of said elongate rail the elongate lip on said rail interlocks and engages with said barb to retain the first end of said slat within said opening in said elongate rail.

2. The improvement in chain link fencing in accordance with claim 1, wherein a pair of separate, distinct, spaced apart barbs are positioned adjacent to the respective lateral edges of each of said slats, whereby when a mutually respective first end of a slat is inserted in the opening between the sides of said elongate rail, the elongate lip on said rail interlocks and engages with each of the barbs at the opposite lateral edges of said slat to retain the first end of said slat within said opening in said elongate rail.

3. The improvement in chain link fencing in accordance with claim 2, wherein the barbs are formed by a pair of separate, distinct, spaced apart slits cut in each of said slats closely adjacent to the first end thereof, said slits being cut into the opposite lateral edges of said slat by a distance of at least about the wall thickness of the lateral edges of said slat and no greater than all the way through said lateral edges of said slats, each slit extending into the broad side of the slat by a distance no greater than about three eighths of the width of the broad side.

4. The improvement in chain link fencing in accordance with claim 3, wherein each said slit is inclined such that the plane of the slit slants inwardly from said one of the broad sides of said slat toward said first end of said slat, with said plane making an acute angle of between about 5 and 75 degrees with said broad side of the slat.

5. The improvement in chain link fencing in accordance with claim 3, wherein each said slit extends at least about one fourth and no greater than about three fourths of the way through said lateral edges of said slats.

6. The improvement in chain link fencing in accordance with claim 3, wherein said elongate lip slants so as to form an acute angle of between about 5 and 85 degrees with the respective side of said elongate rail.

7. The improvement in chain link fencing in accordance with claim 6, wherein the free lateral edge of said lip has a substantially sharp knife-edge pointing toward the base of said rail.

8. An elongate slat for weaving through the links of the chain link fencing, said slat comprising a pair of broad, elongate side members having respective elongate side edges, said side members being spaced apart by first and second lateral edges that join respective side edges of said side members together to form a substantially hollow, flattened, tubular shape; and a barb positioned adjacent to the first lateral edge of said slat, with said barb being formed by an angled slit formed at said first lateral edge, wherein said slit has an apex positioned near the intersection of the broad side of said slat and said first lateral edge, and further wherein one side of the slit slants downwardly from said apex into the broad side of the slat in a direction toward a near end of the slat and the other side of the slit slants downwardly from said apex into the first lateral edge in a direction toward the near end of said slat.

9. A slat in accordance with claim 8, wherein a second barb is positioned adjacent to the second lateral edge of said slat, with said second barb being formed by an angled second slit formed at said second lateral edge, wherein said second slit has an apex positioned near the intersection of the broad side of said slat and said second lateral edge, and further wherein one side of the second slit slants downwardly from said apex into the broad side of the slat in a direction toward a near end of the slat and the other side of the second slit slants downwardly from said apex into the second lateral edge in a direction toward the near end of said slat.

10. A slat in accordance with claim 9, wherein said first and second slits are cut into the respective first and second lateral edges of said slat by a distance of at least about the wall thickness of the respective lateral edges of said slat and no greater than all the way through said respective lateral edges of said slats, and each of said first and second slits extend into the broad side of the slat by a distance no greater than about three eighths of the width of the broad side.

11. A slat in accordance with claim 10, wherein each of said first and second slits is inclined such that the plane of each slit slants inwardly from said one of the broad sides of said slat toward said first end of said slat, with said plane of each slit making an acute angle of between about 5 and 75 degrees with said broad side of the slat.

12. A slat in accordance with claim 10, wherein each of said first and second slits extends at least about one fourth and no greater than about three fourths of the way through said lateral edges of said slat.

13. Chain link fencing comprising a plurality of elongate slats having first and second longitudinal ends, with each slat being characterized by a broad elongate side and a pair of lateral flanges extending from the lateral edges of said slats;

an elongate rail woven between consecutive links of the chain link fence such that the rail lies adjacent to mutually respective, aligned, first ends of said elongate slats, said elongate rail having two sides which extend from a base to form the general shape of a trough, with the extending margins of said sides lying adjacent to each other to form an elongate opening therebetween;

an elongate, engageable lip projecting inwardly from the margin of at least one of the sides of said rail toward the central portion of said rail; and a pair of separate, distinct barbs formed in said lateral flanges adjacent to the respective first ends of said elongate slats, wherein when a mutually respective first end of a slat is inserted in the opening between the sides of said elongate rail, the elongate lip on said rail interlocks and engages with each of the barbs at the opposite lateral edges of said slat to retain the first end of said slat within said opening in said elongate rail.

14. The improvement in chain link fencing in accordance with claim 13, wherein the barbs are formed by a pair of separate, distinct, spaced apart slits cut in each of said flanges closely adjacent to the first end thereof.

15. A method of cutting a pair of distinct, separate, spaced apart slits in the opposite side portions of an elongate tubular slat made of a plastic material wherein said slat is of the type being characterized by a pair of broad, elongate sides which are spaced apart by a pair of lateral edges that join the opposite sides together to from a substantially hollow, flattened, tubular shape, said method comprising placing the end of the slat over a support;

depressing the slat along its longitudinal central axis to press the central portion of the broad sides downwardly against the support, with the opposite side portions of the slat projecting upwardly from the depressed central portions of the broad sides; and cutting said slits in the upwardly projecting portions with a sharp knife edge.

16. A method in accordance with claim 15, wherein the support has a shallow, concave surface.

17. An elongate slat for weaving through the links of chain link fencing, said slat comprising by a pair of broad, elongate sides which are spaced apart by a pair of lateral edges that join the opposite sides together to form a substantially hollow, flattened, tubular shape, with the opposite sides being depressed toward each other along the longitudinal center lines of each so that the slat has a transverse cross section having the general shape of a figure 8; and a barb positioned adjacent to a respective lateral edge of said slat.

18. A slat in accordance with claim 17, wherein a pair of separate, distinct, spaced apart barbs are positioned adjacent to the respective lateral edges of said slat.

* * * * *